US008228352B1

(12) United States Patent
DiSanto et al.

(10) Patent No.: US 8,228,352 B1
(45) Date of Patent: Jul. 24, 2012

(54) PREDETERMINED VOLTAGE APPLICATIONS FOR OPERATION OF A FLAT PANEL DISPLAY

(75) Inventors: Frank J. DiSanto, Melville, NY (US); Denis A. Krusos, Melville, NY (US)

(73) Assignee: CopyTele, Inc., Melville, NY (US)

( * ) Notice: Subject to any disclaimer, the term of this patent is extended or adjusted under 35 U.S.C. 154(b) by 655 days.

(21) Appl. No.: 12/322,153

(22) Filed: Jan. 29, 2009
(Under 37 CFR 1.47)

Related U.S. Application Data

(60) Provisional application No. 61/063,185, filed on Feb. 1, 2008.

(51) Int. Cl.
*G09G 5/10* (2006.01)

(52) U.S. Cl. ..... 345/690; 345/691

(58) Field of Classification Search ..... None
See application file for complete search history.

(56) References Cited

U.S. PATENT DOCUMENTS 4,655,897 A 4/1987 DiSanto et al.
4,742,345 A 5/1988 DiSanto et al.
5,053,763 A 10/1991 DiSanto et al.
5,561,443 A 10/1996 DiSanto et al.
2004/0164665 A1* 8/2004 Sasaki et al. ..... 313/495
2005/0104494 A1* 5/2005 Yotani et al. ..... 313/2.1
2005/0162063 A1* 7/2005 DiSanto et al. ..... 313/495
2005/0162064 A1* 7/2005 DiSanto et al. ..... 313/495
2005/0168811 A1* 8/2005 Mattei ..... 359/389
2006/0170330 A1* 8/2006 DiSanto et al. ..... 313/495
2006/0290262 A1* 12/2006 Krusos et al. ..... 313/495
2006/0290289 A1* 12/2006 Feldman et al. ..... 315/169.3

* cited by examiner

*Primary Examiner* — Paul Huber
(74) *Attorney, Agent, or Firm* — Law Office of Carl Giordana, PA

(57) ABSTRACT

A flat panel display comprises: a cathode; an anode having a plurality of associated pixels; and, a control frame. The display has nanotubes disposed thereon; such that when a predetermined voltage is applied to the frame the nanotubes emit electrons that strike the pixels thus increasing the brightness of a displayed image. The display also includes a plurality of TFT circuits, each being associated with a corresponding one of the pixels. Increasing the predetermined voltage, after the threshold has been reached, will increase the quantity of electrons emitted by the nanotubes and increase the brightness of the image displayed. This voltage applied to the frame and associated nanotubes may be a pulsed voltage.

17 Claims, 6 Drawing Sheets

PREDETERMINED VOLTAGE APPLICATIONS FOR OPERATION OF A FLAT PANEL DISPLAY

FIELD OF THE INVENTION

This application is generally related to the field of displays and more specifically to the displays using Thin Film Transistor (TFT) technology and nanotubes.

BACKGROUND OF THE INVENTION

Flat panel display (FPD) technology is one of the fastest growing technologies in the world with a potential to surpass and replace Cathode Ray Tubes (CRTs) in the foreseeable future. As a result of this growth, a large variety of FPDs exist, which range from very small virtual reality eye tools to large TV-on-the-wall displays.

Various types of displays exist, such displays utilizing both hot and cold cathodes that produce electrons that activate phosphor. In the prior art, a grid or mesh structure is disposed between the cathode and anode elements. Such structures are depicted in various patents issued by Copytele, Inc., the assignee herein, including, for example, U.S. Pat. Nos. 4,655,897, 4,742,345, 5,053,763, and 5,561,443, the subject matter of these patents is hereby incorporated by reference herein in their entireties.

Display devices that utilize nanotubes, as well as other field emission devices, have an inherent threshold at which emission will commence. For nanotube based display devices, the threshold is a negative voltage which is a function of the spacing between the nanotubes and the electrode upon which the electrons emitted by the nanotube will impinge. Typically, a DC voltage has been applied to generate electron emission from the nanotubes, such that the nanotube-based FED essentially operates as an electron gun of a CRT. Alternative mechanisms for operating a display device are desired.

SUMMARY OF THE INVENTION

According to an embodiment of the invention, a device useful as a flat panel display, includes an electron emission system comprising nanotubes, a pixel control system with each pixel containing phosphor and with pixels having memory. Operating the device by applying a pulsed voltage to the nanotubes in synchronism with a frame pulse for writing information to the pixel causes a desired image to be displayed on the device.

A flat display comprises: a cathode; an anode having a plurality of associated pixels; and, a control frame having nanotubes disposed thereon; and that when a negative voltage pulse is applied to the frame, the nanotubes emit electrons that strike the pixels thus increasing the brightness of a displayed image.

In another embodiment of the invention, a threshold voltage associated with nanotube electron emission is a negative DC voltage the magnitude of which is a function of the spacing between the nanotubes and the anode electrode upon which the electrons emitted by the nanotubes will impinge.

In yet another embodiment of the invention, increasing the negative potential to the nanotubes, after the threshold has been reached, will increase the quantity of electrons emitted by the nanotubes, and therefore, will increase the brightness of the image displayed. In still another embodiment of the invention, a pulsed voltage is applied to the frame and associated nanotubes in order to increase the operational efficiency and the life of the display.

BRIEF DESCRIPTION OF THE DRAWINGS

Understanding of the present invention will be facilitated by consideration of the following detailed description of the preferred embodiments of the present invention taken in conjunction with the accompanying drawings, in which like numerals refer to like parts.

Figure 1:
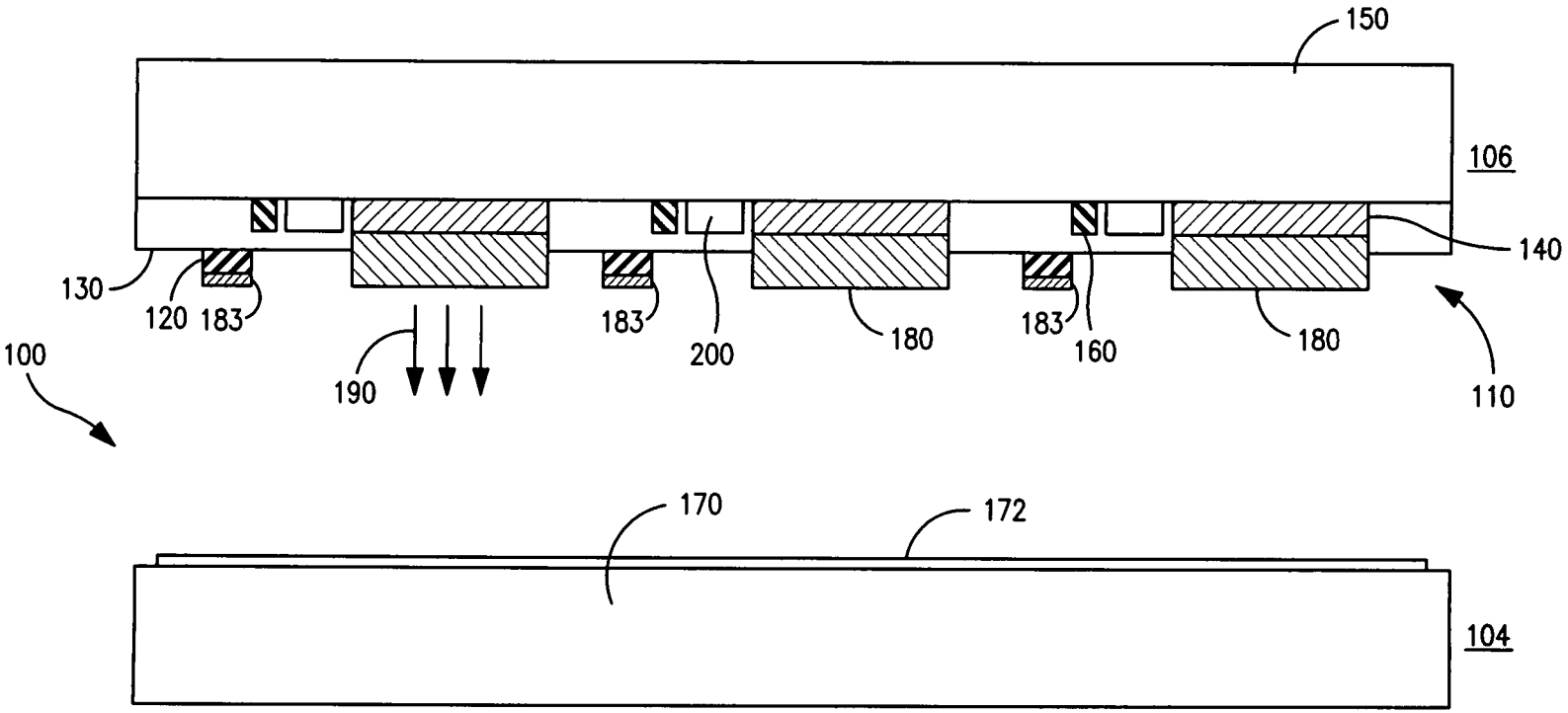
FIG. 1 illustrates a cross-sectional view of a display device according to an exemplary embodiment of the present invention.

It is to be understood that these drawings are solely for purposes of illustrating the concepts of the invention and are not drawn to scale. The embodiments shown herein and described in the accompanying detailed description are to be used as illustrative embodiments and should not be construed as the only manner of practicing the invention. Also, the same reference numerals, possibly supplemented with reference characters where appropriate, have been used to identify similar elements.

DETAILED DESCRIPTION OF THE PREFERRED EMBODIMENTS

Before embarking on a more detailed discussion, it is noted that passive matrix displays and active matrix displays are FPDs that are used extensively in various display devices, such as laptop and notebook computers, for example. In a passive matrix display, there is a matrix of solid-state elements in which each element or pixel is selected by applying a potential voltage to corresponding row and column lines that collectively form the matrix. In an active matrix display, each pixel is further controlled by at least one transistor and a capacitor that is also selected by applying a corresponding row and column lines.

Figure 2:
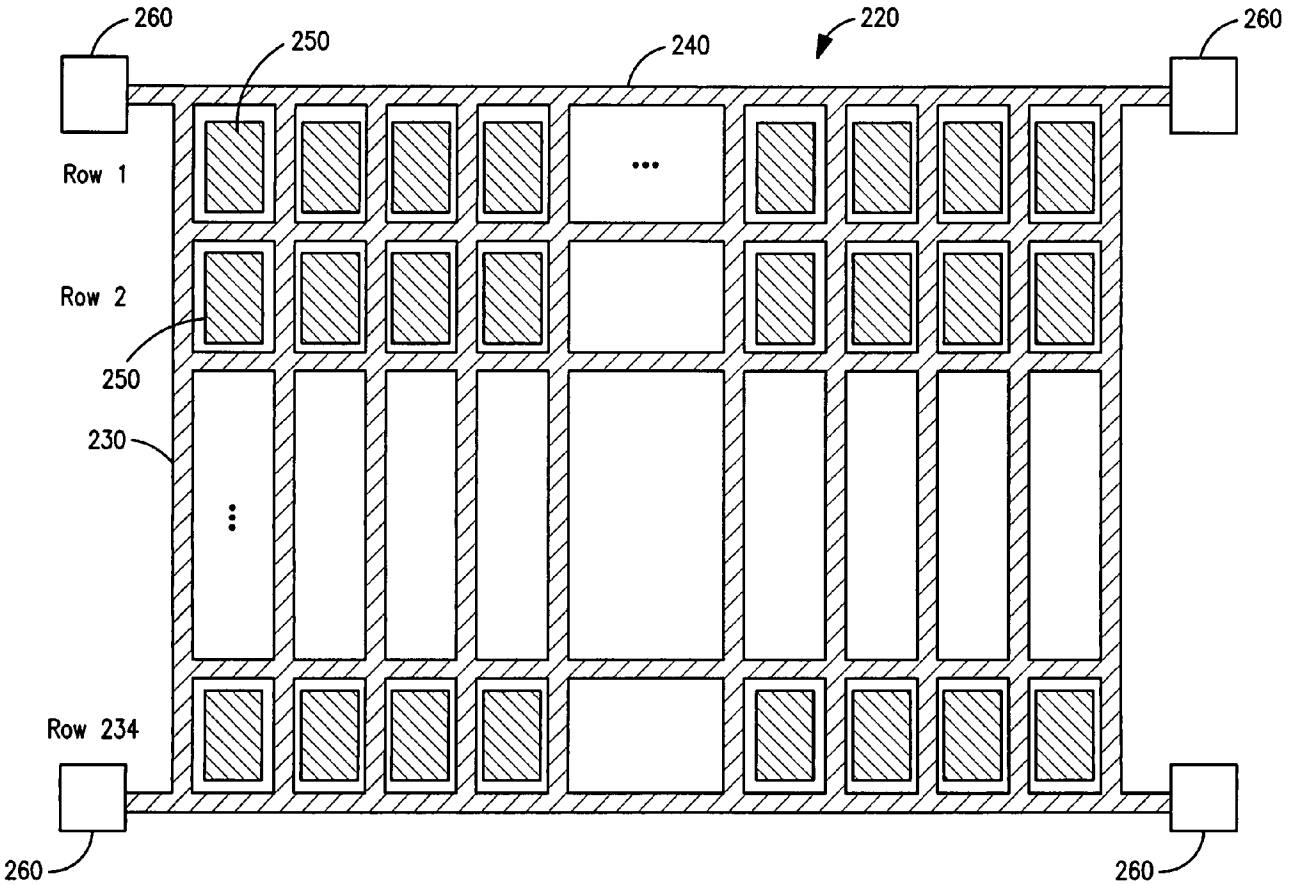
FIG. 2 is a top plan view of a display device employed with this invention.

Referring now to FIGS. 1 and 2, a control frame 220 (120 of FIG. 1) surrounds each pixel in a matrix display and is disposed in an area between the pixels (e.g., on an insulating substrate over the respective columns and rows). The control frame 220 includes a plurality of conductors 230 and 240 arranged in a matrix having parallel horizontal conductors 240 and parallel vertical conductors 230. Each pixel 250 is bounded by the intersection of vertical and horizontal conductors such that the conductors surround the corresponding pixels to the right, left, top, and bottom in a matrix fashion. One or more conductive pixel pads are electrically connected to the control frame. The control frame may be fabricated of a metal including, for example, chrome, molybdenum, aluminum, and/or combinations thereof.

The control frame can be formed using standard lithography, deposition and/or etching techniques.

Figure 3:
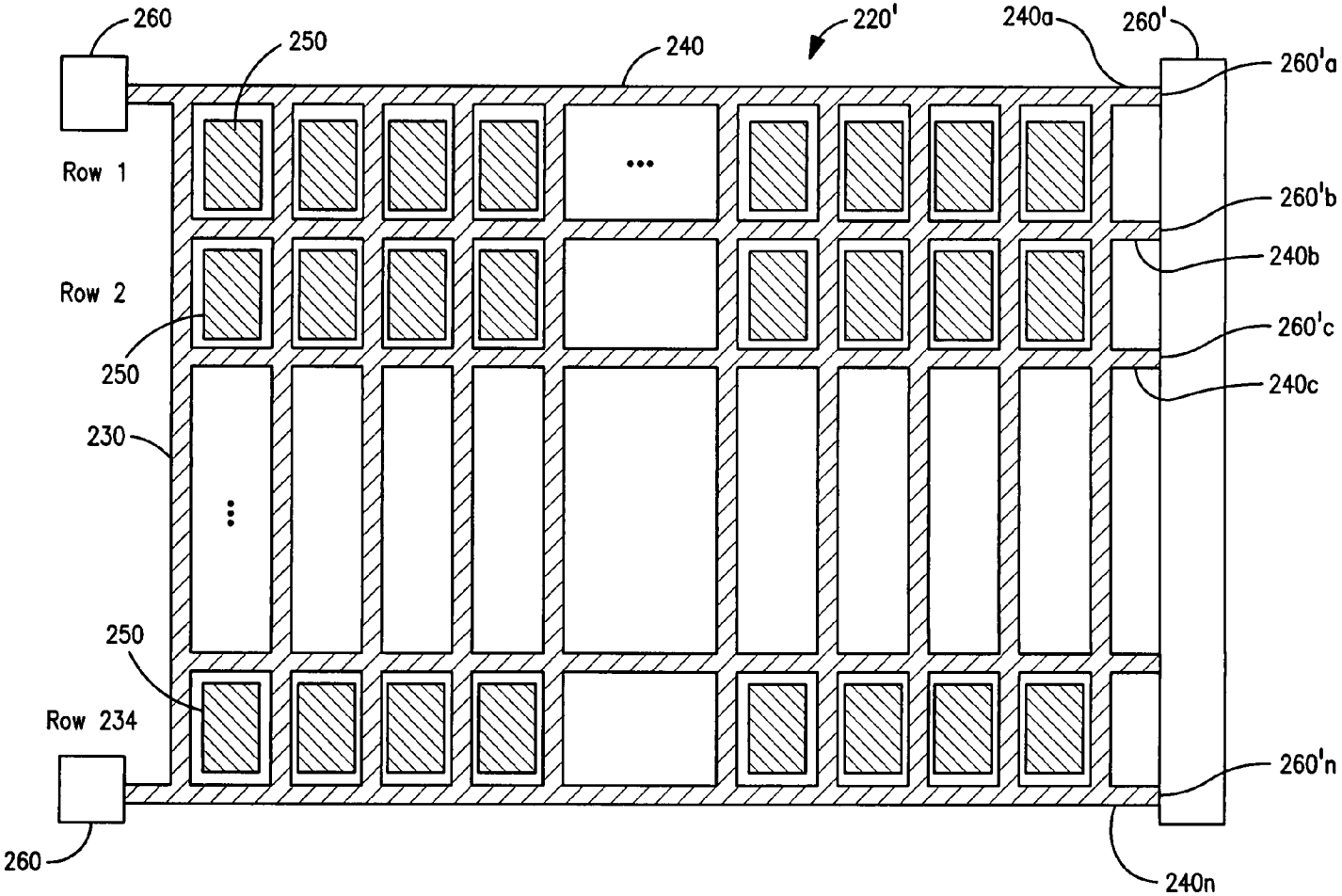
FIG. 3 is a top plan view of an alternate display device employed with this invention.

In one exemplary configuration, control frame conductors parallel to columns and rows are electrically connected together, and a voltage is applied thereto (FIG. 2). In another exemplary configuration, conductors parallel to columns are electrically connected together, and have a voltage applied thereto (FIG. 3). Conductors parallel to the rows are also connected together, with a voltage applied thereto. In yet another exemplary configuration, a voltage is only applied to one of the parallel rows or columns of conductors.

Such a control frame can accommodate carbon nanotube electron emission structures, and be suitable for operation at low voltages, such as at a voltage of less than around 40 volts. According to an embodiment of the present invention, the electron emitting structures may take the form of nanostructures, such as carbon nanotubes. The diameter of a nanotube is typically on the order of a few nanometers. According to an embodiment of the present invention, single-wall carbon nanotubes (SWNTs) and/or multiple wall carbon nanotubes (MWNTs) may be used. The nanostructures may be applied to the control frame using any conventional methodology, such as spraying, growth or printing, for example.

FIG. 1 illustrates a schematic cross-sectional view of an FPD 100 useful for implementing the present invention. In the exemplary embodiment, display 100 is composed of an assembly 110 that includes an anode. TFT circuitry 200, and a control frame structure 120 disposed on anode passivation layer 130. TFT circuitry 200 may be omitted where FPD 100 is a passive X-Y matrix-based display. Control frame 120 substantially surrounds each of a plurality of pixel elements 140/180 as shown in FIGS. 2 and 3 and supports electron emitting nanotubes. In the illustrated embodiment, the pixel metal pads 140 operate as the anode, which attracts electrons emitted by frame 120 supported emitters, e.g., carbon nanotubes or other emitters.

Conductive pixel pads 140 are fabricated in a matrix of substantially parallel rows and columns on a substrate 150 using conventional fabrication methods. Substrate 150 may be formed of a transparent material, such as glass, or a flexible material (such as a plastic with no internal outgassing during sealing and vacuumization processing), but may be opaque.

Conductive pixel pads 140 may be composed of a transparent conductive material, such as ITa (Indium Titanium Oxide) or a non-transparent conductor such as Chrome (Cr), Moly Chrome (MoCr) or aluminum. Deposited on each conductive pixel pad 140 is a phosphor layer 180. Each phosphor layer 180 is selected from materials that emit light 190 of a specific color, wavelength, or range of wavelengths. In a conventional RGB display, phosphor layer 180 is selected from materials that produce red light, green light or blue light when struck by electrons. In the illustrated embodiment, light (i.e., photons) is emitted in the direction of substrate 170 for viewing. If the pixel metal is of a transparent (or translucent) material (such as ITO) rather than opaque, light emissions 190 may be transmitted in both the directions of substrates 150 and 170 (rather than being reflected via the pixel metal towards substrate 170 only, for example).

FPD 100 also includes conductive pixel column and row addressing lines 160 associated with each of the corresponding conductive pixel pads 140. The pixel row and column addressing lines may be substantially perpendicular to one another as shown in FIGS. 2 and 3. Such a matrix organization of conductive pixel pads and phosphor layers allows for X-Y addressing of each of the individual pixel elements in the display as will be understood by those possessing an ordinary skill in the pertinent arts.

Where FPD 100 takes the form of an active display, associated with each conductive pixel pad 140/phosphor layer 180 pixel is a TFT circuit 200 that operates to apply an operating voltage to the associated conductive pixel pad 140/phosphor layer 180 pixel element. TFT circuit 200 operates to apply either a first voltage to bias an associated pixel element to maintain it in an "off" state or a second voltage to bias the associated pixel element to maintain it in an "on" state, or any intermediate state. In this illustrated case, conductive pixel pad 140 is inhibited from attracting electrons when in an "off" state, and attracts electrons when in an "on" or any intermediate state. In such a case, TFT circuitry 200 biasing conductive pixel pad 140 provides for the dual functions of addressing pixel elements and maintaining the pixel elements in a condition to attract electrons for a desired time period, i.e., time-frame or sub-periods of time-frame.

Substrate 170, which serves to confine the FPD housing in an evacuated environment may be made of a transparent (or at least translucent) material, such as glass or flexible material, but alternatively may be opaque.

In the illustrated embodiment of the present invention, substrate 170 supports a conductive layer 172. Layer 172 may be composed of a transparent conductor, such as ITO (Indium Titanium Oxide), or another conductive material, for example. In operation, conductive layer 172 may be biased to around 15-30 Volts. The layer 172 can be used for other purposes in an active or passive display.

Referring no also to FIG. 2, there is shown a top plan view of a control frame 220 suitable for use as control frame 120 FIG. 1. Control frame 220 includes a plurality of conductors arranged in a rectangular matrix having parallel vertical conductive lines 230 and parallel horizontal conductive lines 240, respectively. The conductive lines 230 are sometimes referred to as columns, while lines 240 are referred to as rows. Each pixel 250 (e.g. pad 140 and phosphor 180 of FIG. 1) is bounded by vertical and horizontal conductors or lines 230, 240 such that the conductors substantially surround each pixel 250 to the right, left, top, and bottom. One or more conductive pads 260 electronically connect conductive frame 220 to a conventional power source. In the illustrated embodiment of FIG. 2, four conductive pads 260 are coupled to the conductive lines 230, 240 of frame 220. In an exemplary embodiment, each pad 260 is around 100×200 micrometers (microns) in size. In the embodiment of FIG. 2, a first stripe 172 (FIG. 1) may be substantially aligned with pixels 250 in "Row 1", a second strip 172 (FIG. 1) may be substantially aligned with pixels 250 in "Row 2", and so on. Thus, the conductor (ITO) on substrate 170 may be a series of row/lines.

FIG. 3 shows another exemplary configuration of a control frame structure similar to that of FIG. 2 (wherein like references numerals are used to indicate like parts); but wherein two of the pads 250 of FIG. 2 are replaced by a single conductive bar or bus 260'. The conductive bar 260' is coupled to each of the parallel horizontal conductive lines 240*a*, 240*b*, 240*c* . . . 240*n* at corresponding positions 260*a*, 260*b*, 260*c* . . . 260*n* along the bar. In the illustrated configuration, the row lines are substantially identical to one another and interconnect to the bar at uniform spacings along the length of the bar. This configuration provides for an equipotential frame configuration with minimal voltage drops as a function of frame position. Again, in the embodiment of FIG. 3, a first stripe 172 (FIG. 1) may be substantially aligned with pixels 250 in "Rox 2", and so on.

In the illustrated embodiments, control frame 220 (or 220') is formed as a metal layer above the final passivation layer (e.g. 130, FIG. 1). Pads 260 and metal lines that provide the control frame structure 220 remain free from passivation in the illustrated embodiment. In an exemplary configuration, the control frame metal layer has a thickness of less than about 1 micron (urn), and a width on the order of about 16-19 microns, although other thicknesses and widths may be used depending on particular design criteria.

While the vertical line conductors 230 and horizontal line conductors 240 frame each pixel 250 above the plane of the pixels 250 in the illustrated embodiment (see, e.g., FIG. 1), other configurations are contemplated, such as where the conductors are disposed in the same plane as the pixels. Further yet, conductors 230, 240 may be connected in a number of configurations. For example, in one configuration, all horizontal and vertical conductors are joined together as shown in FIG. 2 and a voltage is applied to the entire control frame configuration. In another configuration, all horizontal conductors 240 are joined and separately all vertical conductors 230 are joined. In this connection configuration the horizontal conductors 240 and vertical conductors 230 are not electrically interconnected. Thus, a voltage may be applied to the horizontal conductor array, and a separate voltage may be applied to the vertical conductor array. Other configurations are also contemplated, including for example, a configuration of all horizontal conductors only, or a configuration of all vertical conductors only. For example, the control frame may include only metal lines parallel to the columns or only metal lines parallel to the rows.

Referring to FIG. 1, it is indicated that a voltage equal to γpixel (low)−(γTHN) may be applied to the frame 100, where (γTHIN) represents the nanotube 183 emitting threshold voltage and γpixel (low) represents the minimal pixel voltage. As seen in FIG. 1 carbon nanotubes 183 are positioned on the control frame. They can be positioned on the row conductors at an X-Y intersection or anywhere on the display. This voltage may serve to keep the nanotube structures 183 to just below the electron emitting threshold when the pixel voltage is in it's "OFF" state. This permits the pixel voltage from the "OFF" state to the "ON" state and all voltages in between to cause changes in brightness. The nanotubes 183 have an inherent threshold at which electron emission will commence and as that threshold is reached and exceeded electrons travel from their location on the frame 200 (120 of FIG. 1) (220 of FIG. 2) (220' of FIG. 3) towards the anode. A least voltage applied to the control frame 100 has the effect of causing sufficient electrons to flow from the nanotubes 183 to the anode phosphor layer 180 or pixel element to produce a measurable increase in the be of the display. The voltage is essentially above the voltage (γPIXEL (low)−(γTHN)), i.e. the potential difference between the threshold voltage and the pixel voltage. The potential applied to the frame 220 (FIGS. 2 & 3) is a negative voltage having a magnitude which is a functional of the spacing between the nanotubes 183 and phosphor layer pixel element 180 upon which the electrons emitted by the nanotubes 183 will impinge. It has been found that increasing this negative v potential, after the threshold has been reached, will increase the quantity of electrons emitted by the nanotubes 183 and in the of the display using phosphor to produce the d increase the brightness of the image displayed.

Figure 4:
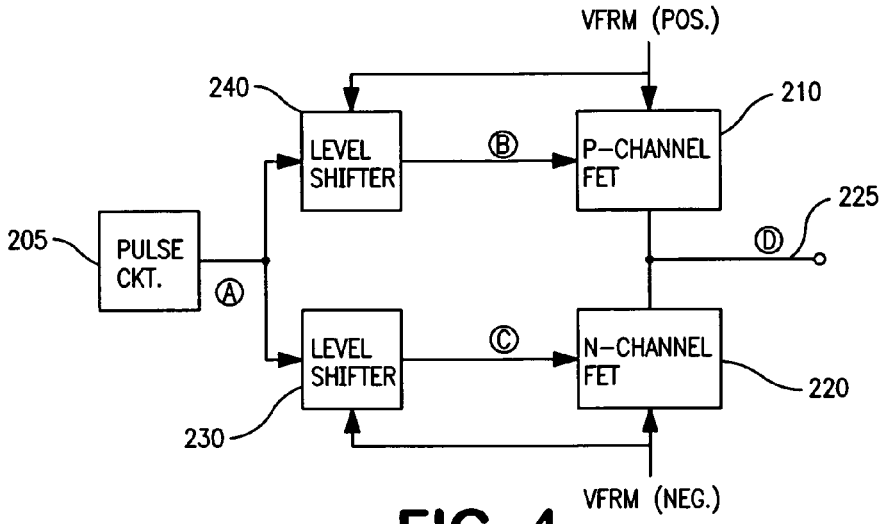
FIG. 4 illustrates a block diagram of a pulse generator according to an exemplary embodiment of the present invention.
Figure 5:
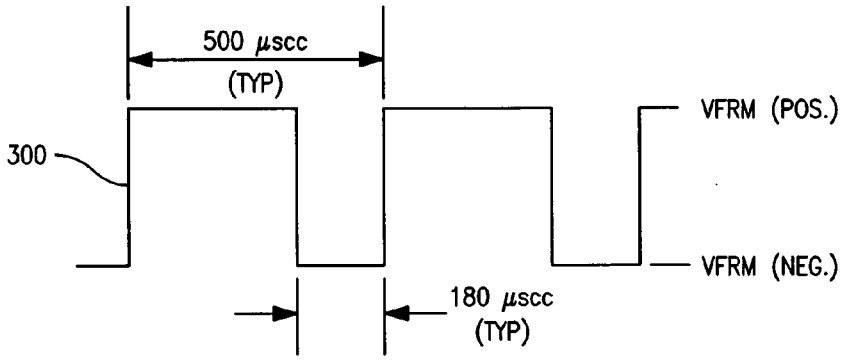
FIG. 5 illustrates voltage levels for driving a frame according to an exemplary embodiment of the present invention.
Figure 6:
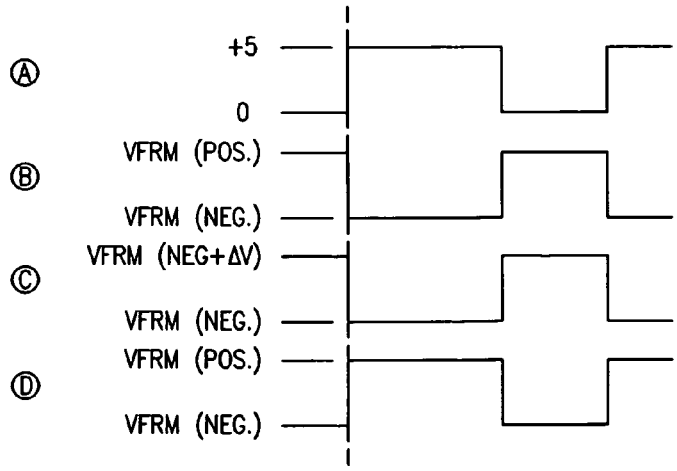
FIG. 6 illustrates a timing diagram according to an exemplary embodiment of the present invention.

It has been discovered that a pulsed voltage of the proper polarity applied to the frame 120 (220 of FIG. 2) (220' of FIG. 3) causes the nanotubes 183 to emit electrons which increases the operational efficiency and the life expectancy of the display. Those skilled in the art of electronic circuit design are familiar with the design, construction and operation of circuits that produced pulsed voltages. For purposes of explanation and not limitation, FIG. 4 illustrates a pulse generator 205 that outputs at output terminal 225 a rectangular wave that switches between zero (0) and five (5) volts. Level shifters 230, 240 produce the wave shapes illustrated in FIG. 6 B, C respectively. The pulse circuit illustrated in FIG. 4 thereby supplies to the frame 120 of FIG. 1, 220 of FIGS. 2 and 220' of FIG. 3 a threshold voltage 300 as illustrated in FIG. 5 having an on/off period or duty cycle that causes the periodic emission of electrons from the nanotubes 183 disposed on the frame.M8 to travel to the phosphor layer pixel element 180.

Figure 7:
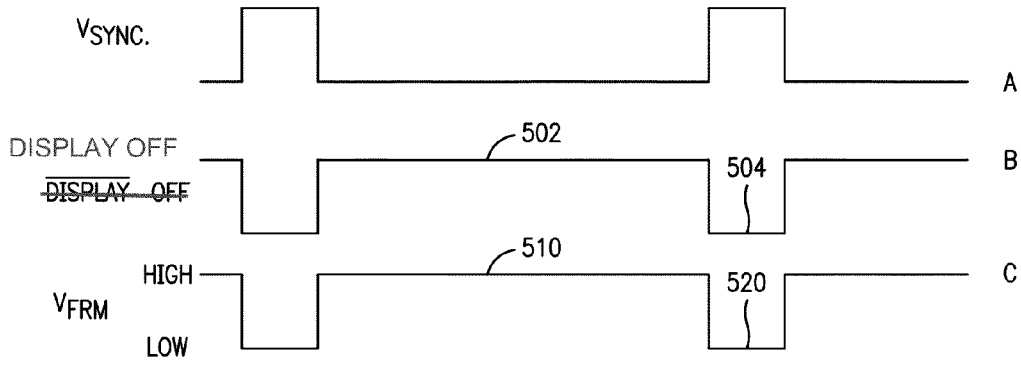
FIG. 7 illustrates timing diagrams for driving pixels according to an exemplary embodiment of the present invention.
Figure 8:
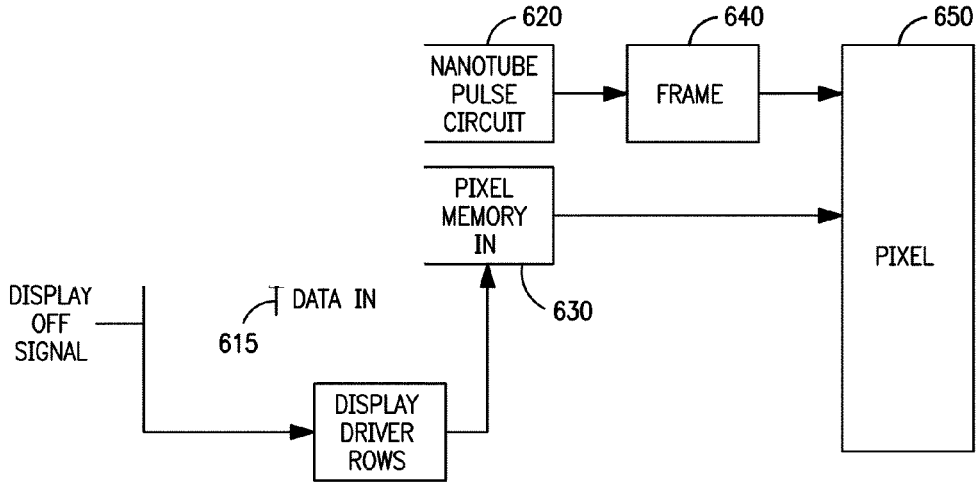
FIG. 8 illustrates a circuit for driving pixels according to an exemplary embodiment of the present invention.

The flat panel display described herein comprises: the substrate 104; substrate 106 having a plurality of associated phosphor layer pixel elements 180; and, control frame 220 having nanotubes 183 disposed thereon; such that when a least voltage is applied to the frame 220 of FIG. 2 the nanotubes 183 emit electrons that strike the pixels thus increasing the brightness of a displayed image 195. Referring to FIG. 8 display drivers 605 apply the desired data information 615 to each display pixel to produce the desired image within the timing constraints illustrated in FIG. 7. Each phosphor layer pixel element 180 has memory regarding the last data information supplied by the drivers 605, during the preceding scan of the matrix. In synchronism with a frame start pulse as shown in FIG. 7A the controller (not shown) activates a "display off" signal 502 (FIG. 7B) to activate the column display drivers 605 and applies the data information 615 to the memory 630 of each pixel 650. The display off signal also activates low mode as shown in FIG. 7C during a time interval 510 the voltage applied to the frame 220 thereby nanotubes 183 is at a value that causes no emission. After data 615 has been written to each of the pixel memory 630 the controller "display off" signal 504 (FIG. 7B) causes the driver 605 outputs to go to a low and pulses the frame and associated nanotubes 183 with a negative voltage during a time interval 520 (FIG. 7C) to cause the nanotubes to emit electrons. The image is then written in accordance to the data last applied to the pixel memory 630. The ratio of nanotube 183 "on" time to "off" time is determined by the controller to produce the desired image brightness as efficiently as possible. Additionally, the least voltage pulsed rectangular wave has a duty cycle chosen dependent upon producing the desired image brightness as efficiently as possible.

Figure 9:
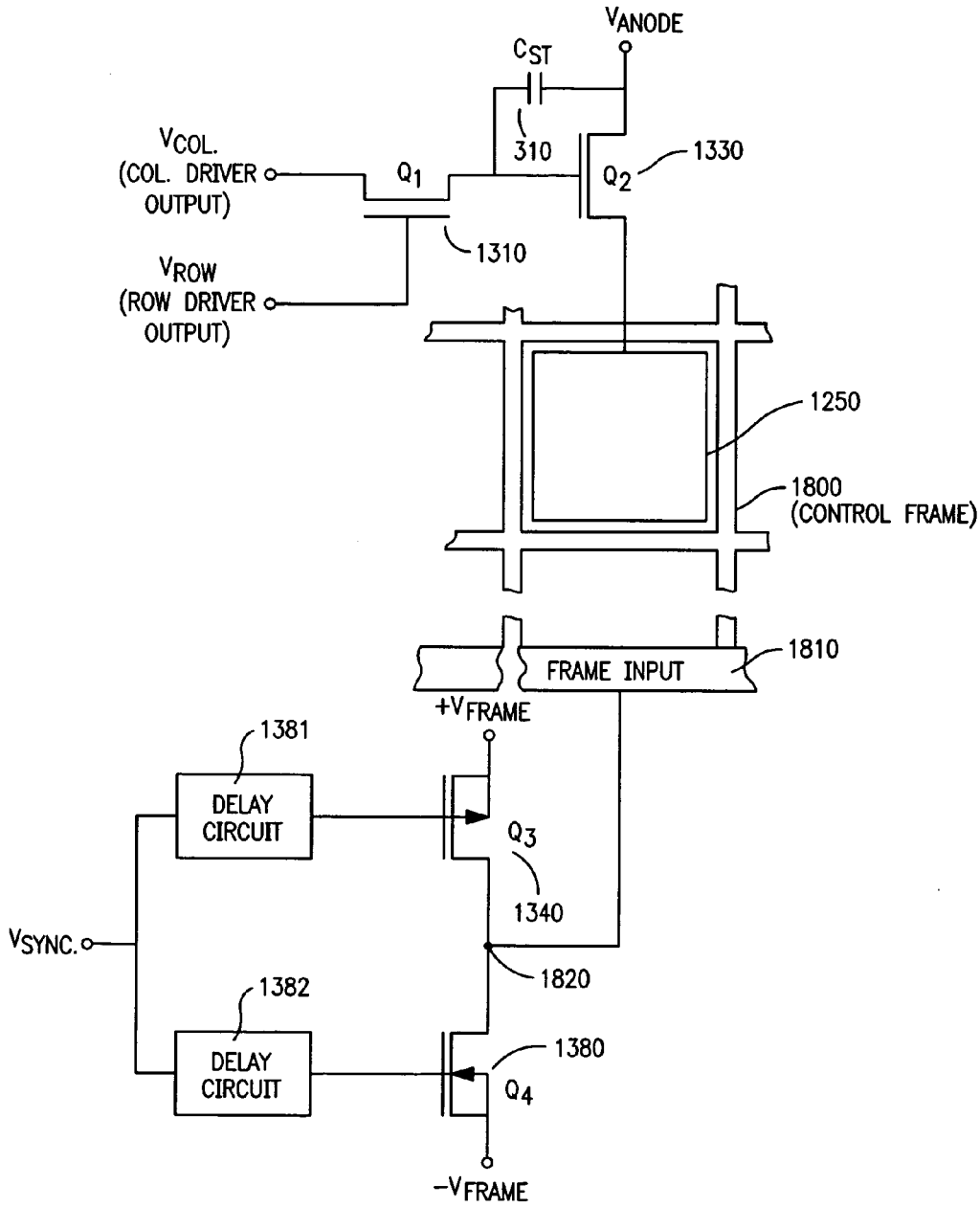
FIG. 9 illustrates a circuit diagram of a TFL pixel and pixel drives according to an exemplary embodiment of the present invention.

Referring to FIG. 9 there is shown a circuit diagram of a PIXEL and FRAME DRIVER. It is noted that thin film transistors (TFTs) are employed but any active device as FET's, MOSFET's and soon can be used. A first TFT ($Q_1$) 1310 has the gate electrode coupled to γrow, which the voltage is used to select rows of the display. The TFT has output electrodes as a source and drain. In any event these terms can be interchanged. One terminal of TFT 1310 is connected to a signal designated as γcol. which is the column driver voltage. The output of TFT 1310 is coupled to the gate electrode of TFT 1330 ($Q_2$). The drain or output of TFT 1330 is coupled to an operating potential γanode. A capacitor 310 ($C_{ST}$) couples the drain of 1330 to the gate input of TFT 1330. The source of TFT 1330 is connected to pixel 1250 surrounded by control frame 1800. The frame input 1810 is connected to terminal 1820 on the junction between outputs of TFT 1340 ($Q_3$) and TFT 1380 ($Q_4$). TFT 1340 has the gate coupled to the output of a delay circuit 1381. The gate electrode of TFT 1380 is coupled to the output of a delay circuit 1382. The inputs of delay circuit 1381 and 1382 are coupled to a signal input γsync. This is the synchronizing display signal as seen TFT 1340 and 1380 are connected in series between a positive voltage +γframe and a negative voltage −γframe. The TFT are of opposite conductivity as one is N-Type and the other is P-Type. The junction 1820 is the terminal connected to the drain of $Q_3$ to the drain of $Q_4$. Thus from FIG. 9 it is seen that when a Row X and a Column Y is selected (X, Y) transistor 1310 turns on activation transistor 1330 an applying voltage to pixel 1250. The sync signal (FIG. 7A) is applied to the circuit of FIG. 9 and generates the frame signal (FIG. 7C) during internal 510 (FIG. 7C) $Q_1$ and $Q_2$ writes the data relative to the image to be displayed and the information is stored in capacitor $C_{ST}$ (310) on each pixel. During the internal γframe is positive (510 of FIG. 7C) and the nanotubes do not emit between successive frames γframe is new (520 FIG. 7C), the nanotubes emit and the stored data is displayed While there has been shown, described, and pointed out fundamental novel features of the present invention as applied to preferred embodiments thereof, it will be understood that various omissions and substitutions and changes in the apparatus described, in the form and details of the devices disclosed, and in their operation, may be made by those skilled in the art without departing from the spirit of the present invention. It is expressly intended that all combinations of those elements that perform substantially the same function in substantially the same way to achieve the same results are within the scope of the invention. Substitutions of elements from one described embodiment to another are also fully intended and contemplated.

We claim:

1. A flat panel display comprising:

a cathode;

an anode having a plurality of associated pixels; and, a control frame having nanotubes disposed thereon;

means for applying a pulsed predetermined voltage waveform to the control frame, the predetermined voltage waveform having a display-off period in which the predetermined voltage is below a potential difference between a threshold voltage and a pixel voltage required for the nanotubes to emit electrons wherein data information associated with an image is applied to a memory of each pixel during the display-off period, the predetermined voltage having a duty cycle dependent upon producing a desired brightness of the image.

2. The display of claim 1, wherein the predetermined voltage is above the potential difference between the threshold voltage and the pixel voltage required for the nanotubes to emit electrons.

3. The display of claim 2 whereby negatively increasing the predetermined voltage, after the threshold voltage has been reached, increases the quantity of electrons emitted by the nanotubes.

4. The display of claim 1 whereby negatively increasing the predetermined voltage, after the threshold has been reached, increases the brightness of the displayed Image.

5. The display of claim 1, wherein a positive predetermined voltage prevents any electrons from being emitted by the nanotubes.

6. The display of claim 1, wherein the pulsed predetermined voltage operates in synchronism with a frame start pulse.

7. The display of claim 6, wherein the display-off signal activates one or more display drivers.

8. The display of claim 7, wherein during the display-off period the voltage applied to the frame is at a value that causes no nanotube emission.

9. The display of claim 7, wherein after data information has been written to memory of each pixel, the predetermined voltage signal causes the nanotubes to emit electrons.

10. The display of claim 7, wherein the ratio of nanotube "on" time to "off" time is determined to produce the desired image brightness.

11. The display of claim 1, wherein at least one nanotube takes the form of one of a single walled nanotube or a multiple wall nanotube.

12. The display of claim 1, wherein a voltage equal to a a minimum pixel voltage less a voltage equal to the nanotube emitting threshold is applied to the control frame.

13. The display of claim 1, wherein the control frame is disposed on a passivation layer of the anode.

14. The display of claim 1, wherein the control frame comprises a plurality of conductors arranged in a matrix.

15. The display of claim 1, wherein the control frame bounds each pixel by the intersection of a vertical conductor and a horizontal conductor.

16. The display of claim 1, wherein the control frame comprises one of conductors parallel to rows or parallel to columns.

17. The display of claim 1 wherein the control frame includes a set of horizontal and vertical conductors.

* * * * *